US006968269B2

(12) United States Patent
Yamashita

(10) Patent No.: US 6,968,269 B2
(45) Date of Patent: Nov. 22, 2005

(54) ENGINE CONTROL DEVICE

(75) Inventor: Toshihiko Yamashita, Shizuoka-ken (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 0 days.

(21) Appl. No.: 10/509,364

(22) PCT Filed: Apr. 11, 2003

(86) PCT No.: PCT/JP03/04661

§ 371 (c)(1),
(2), (4) Date: Sep. 24, 2004

(87) PCT Pub. No.: WO2004/013476

PCT Pub. Date: Feb. 12, 2004

(65) Prior Publication Data

US 2005/0205057 A1 Sep. 22, 2005

(30) Foreign Application Priority Data

Jul. 31, 2002 (JP) ..... 2002-223665

(51) Int. Cl.[7] ..... F02D 45/00

(52) U.S. Cl. ..... 701/114; 123/406.58

(58) Field of Search ..... 701/114, 115, 102; 73/116, 117.3, 119 R; 123/406.53, 406.56, 123/406.58, 319, 395, 480

(56) References Cited

U.S. PATENT DOCUMENTS

| | | | | |
|---|---|---|---|---|
| 6,340,020 | B2 * | 1/2002 | Yamazaki et al. | 123/478 |
| 2004/0244471 | A1 * | 12/2004 | Sawada et al. | 73/116 |
| 2004/0255902 | A1 * | 12/2004 | Sawada et al. | 123/339.11 |
| 2004/0261767 | A1 * | 12/2004 | Sawada et al. | 123/406.53 |
| 2005/0021220 | A1 * | 1/2005 | Nakamura et al. | 701/115 |

FOREIGN PATENT DOCUMENTS

| | | |
|---|---|---|
| JP | 2000-352348 | 12/2000 |
| JP | 2002-147269 | 5/2002 |

* cited by examiner

*Primary Examiner*—Hieu T. Vo
(74) *Attorney, Agent, or Firm*—Hogan & Hartson, LLP

(57) ABSTRACT

To detect a stroke reliably at the time of the start of the engine when a stroke cannot be detected based on crank pulses alone.

A stroke is detected based on a difference ΔN between the engine rotational speeds at top and bottom dead centers and a flag $F_N$ is changed depending upon whether a temporary stroke set before a stroke has been detected and the detected stroke coincide with each other or not. Simultaneously, a stroke is detected based on a difference ΔP between the intake air pressures at two bottom dead centers and a flag $F_p$ is changed depending upon whether a temporary stroke set before a stroke has been detected and the detected stroke coincide with each other or not. Then, when the flags $F_N$ and $F_p$ coincide with each other, the stroke detection is completed. When the detected stroke differs from the temporary stroke, the stroke is shifted by a phase of 360° and the crank pulses are renumbered.

20 Claims, 12 Drawing Sheets

ENGINE CONTROL DEVICE

BACKGROUND OF THE INVENTION

1. Technical Field

This invention relates to an engine control device for controlling an engine and, more specifically to an engine control device suitable for controlling an engine provided with a fuel injection device for injecting fuel.

2. Background Art

With the widespread use of fuel injection devices called injectors in recent years, the control of the fuel injection timing and the fuel injection amount, namely, the air-fuel ratio has become easy, which makes it possible to improve engine output and fuel consumption and to clean exhaust gas. As to the fuel injection timing, it is common that the phase state of a camshaft, the state of an intake valve, to be exact, is detected, and, based on the detected result, fuel is injected. However, a cam sensor for detecting the phase state of a camshaft, which is expensive and increases the size of a cylinder head, is difficult to employ in motorcycles or the like, in particular. To solve this problem, an engine control device adapted to detect the phase state of a crankshaft and an intake air pressure and, based on those, to detect the stroke state of a cylinder is conventionally known. Thus, it is possible to detect the stroke state of a cylinder without detecting the phase of a camshaft, so that it is possible to control the fuel injection timing based on the stroke state.

The stroke state can be detected based on variations in the engine rotational speed during one cycle. The engine rotational speed is highest in the expansion (explosion) stroke, followed by the exhaust stroke, intake stroke and compression stroke in that order. Thus, the stroke state can be detected from variations in the engine rotational speed and the phase of a crankshaft. A conventional engine control device is adapted to select the stroke detection based on variations in intake air pressure or stroke detection based on variations in the engine rotational speed according to the operating condition of the engine and detect a stroke by the selected method.

With the conventional engine control device, however, it is difficult to select an appropriate stroke detection method over the entire operating conditions of the engine and, in some cases, neither of the stroke detection methods is appropriate. Thus, the reliability of the detected stroke is low.

The present invention has been made to solve the above problem and it is an advantage of the present invention to provide an engine control device which can perform stroke detection with high reliability.

SUMMARY OF THE INVENTION

In order to solve the foregoing problem, the engine control device of the present invention includes a crankshaft phase detecting device that detects the phase of a crankshaft, a intake air pressure detecting device that detects the intake air pressure in an intake pipe of an engine; and a stroke detecting device that detects a stroke of the engine based on at least the phase of the crankshaft detected by the crankshaft phase detecting device. The engine control device also includes an engine control device that controls the operating condition of the engine based on the stroke of the engine detected by the stroke detecting device and the intake air pressure detected by the intake air pressure detecting, and an engine rotational speed detecting device that detects the engine rotational speed. The stroke detecting device detects a stroke based on variations in the intake air pressure detected by the intake air pressure detecting device and detects a stroke based on variations in the engine rotational speed detected by the engine rotational speed detecting device, and completes stroke detection when the detected strokes coincide with each other.

DETAILED DESCRIPTION OF THE INVENTION

Description will be hereinafter made of the embodiment of this invention.

Figure 1:
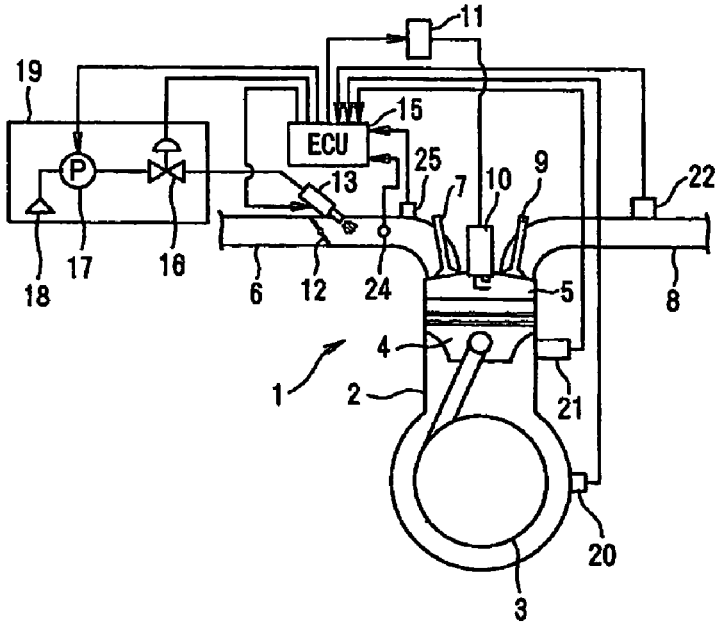
FIG. 1 is a schematic diagram of an engine for a motorcycle and a control device therefor.

FIG. 1 is a schematic diagram illustrating an example of an engine for a motorcycle or the like and a control device therefor. Designated as reference numeral 1 is a relatively small displacement, single-cylinder, four-cycle engine. The engine 1 has a cylinder body 2, a crankshaft 3, a piston 4, a combustion chamber 5, an intake pipe 6, an intake valve 7, an exhaust pipe 8, an exhaust valve 9, a spark plug 10 and an ignition coil 11. In the intake pipe 6, a throttle valve 12 which is opened and closed in accordance with throttle opening is provided and an injector 13 as a fuel injection device is disposed downstream of the throttle valve 12. The injector 13 is connected to a filter 18, a fuel pump 17 and a pressure control valve 16 which are housed in a fuel tank 19.

The operating condition of the engine 1 is controlled by an engine control unit 15. For performing control input into the engine control unit 15, namely for detecting the operating condition of the engine 1, there are provided a crank angle sensor 20 for detecting the rotational angle, namely phase, of the crankshaft 3, a cooling water temperature sensor 21 for detecting the temperature of the cylinder body 2 or cooling water, namely the temperature of the engine body, an exhaust air-fuel ratio sensor 22 for detecting the air-fuel ratio in the exhaust pipe 8, an intake air pressure sensor 24 for detecting the pressure of intake air in the intake pipe 6, and an intake temperature sensor 25 for detecting the temperature in the intake pipe 6, namely the temperature of intake air. The engine control unit 15 receives detecting signals from the sensors and outputs control signals to the fuel pump 17, the pressure control valve 16, the injector 13 and the ignition coil 11.

Here, the principle of the crank angle signals which are output from the crank angle sensor 20 will be described. In this embodiment, a plurality of teeth 23 are formed on an outer periphery of the crankshaft 3 at generally equal intervals as shown in FIG. 2*a*. The crank angle sensor 20, such as a magnetic sensor, detects the approach of the teeth 23, and the resulting current is electrically processed and output as pulse signals. The circumferential pitch between two adjacent teeth 23 is 30° in the phase (rotational angle) of the crankshaft 3, and the circumferential width of each of the teeth 23 is 10° in the phase (rotational angle) of the crankshaft 3. There is a part where two adjacent teeth are arranged not at the above pitch but at a pitch which is twice as large as the others. It is a special part where there is no tooth where there should be one as shown by phantom lines in FIG. 2*a*. This part corresponds to an irregular interval. This part may be hereinafter also referred to as the "tooth missing part".

Thus, when the crankshaft 3 is rotating at a constant speed, the train of pulse signals corresponding to the teeth 23 appears as shown in FIG. 2*b*. FIG. 2*a* shows the state where the cylinder is at compression top dead center (the state is the same as when the cylinder is at exhaust top dead center). The pulse signal output immediately before the cylinder reaches compression top dead center is numbered as "0", and the following pulse signals are numbered as "0", "2", "3" and "4". The tooth missing part, which comes after the tooth 23 corresponding to the pulse signal "4", is counted as one tooth as if there were one there, and the pulse signal corresponding to the next tooth 23 is numbered as "6". When this process is continued, the tooth missing part comes again after a pulse signal "16". The tooth missing part is again counted as one tooth as above, and the pulse signal corresponding to the next tooth 23 is numbered as "18". When the crankshaft 3 rotates twice, the four strokes of one cycle complete, so that the pulse signal which appears after the pulse signal "23" is numbered as "0" again. In principle, the cylinder reaches compression top dead center immediately after the pulse signals numbered as "0" appear. The thus detected pulse signal train or each pulse signal is defined as a "crank pulse". When the stroke detection is performed based on the crank pulse as described later, crank timing can be detected. The teeth 23 may be formed on an outer periphery of a member which is rotated in synchronization with the crankshaft 3.

Figure 3:
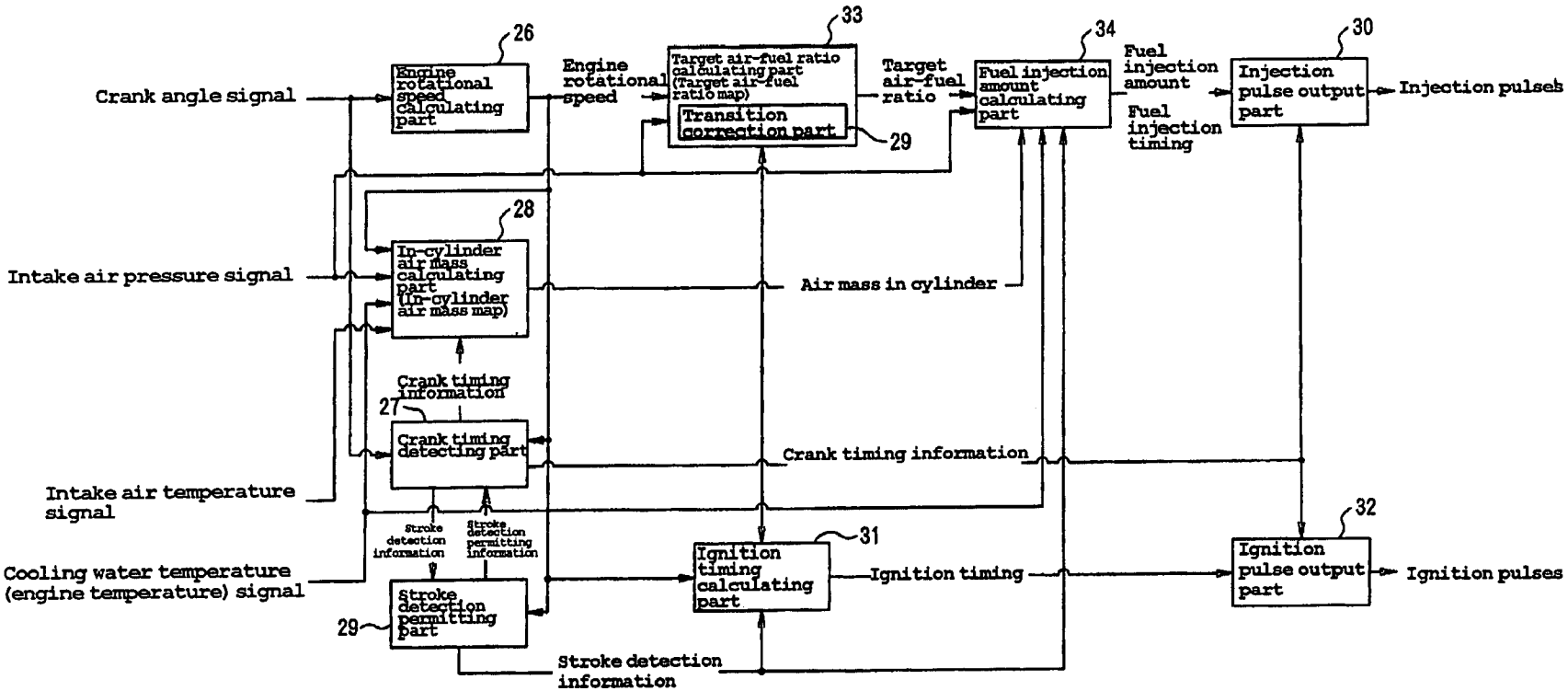
FIG. 3 is a block diagram illustrating one embodiment of the engine control device of the present invention.

The engine control unit 15 is constituted of a microcomputer (not shown) and so on. FIG. 3 is a block diagram illustrating an embodiment of the engine control operation performed by the microcomputer in the engine control unit 15. The engine control operation is performed by an engine rotational speed calculating part 26 for calculating the engine rotational speed based on a crank angle signal, a crank timing detecting part 27 for detecting crank timing information, namely the stroke state, based on the crank angle signal, an intake air pressure signal and the engine rotational speed calculated in the engine rotational speed calculating part 26, and a stroke detection permitting part 29 which reads the engine rotational speed calculated in the engine rotational speed calculating part 26 and outputs stroke detection permitting information to the crank timing detecting part 27 and which reads and outputs stroke detection information provided by the crank timing detecting part 27.

An in-cylinder air mass calculating part 28 is provided for calculating the air mass in the cylinder (amount of intake air) based on the crank timing information detected by the crank timing detecting part 27 together with an intake air temperature signal, a cooling water temperature (engine temperature) signal, the intake air pressure signal and the engine rotational speed calculated in the engine rotational speed calculating part 26. A target air-fuel ratio calculating part 33 for calculating a target air-fuel ratio based on the engine rotational speed calculated in the engine rotational speed calculating part 26 and the intake air pressure signal.

A fuel injection amount calculating part 34 for calculating a fuel injection amount and fuel injection timing based on the target air-fuel ratio calculated in the target air-fuel ratio calculating part 33, the intake air pressure signal, the air mass in the cylinder calculated in the in-cylinder air mass calculating part 28, the stroke detection information output from the stroke detection permitting part 29, and the cooling water temperature signal is also provided. An injection pulse output part 30 for outputting injection pulses corresponding to the fuel injection amount and the fuel injection timing calculated in the fuel injection amount calculating part 34 to the injector 13 based on the crank timing information detected by the crank timing detecting part 27 is provided.

An ignition timing calculating part 31 is provided for calculating ignition timing from the engine rotational speed calculated in the engine rotational speed calculating part 26, the target air-fuel ratio set by the target air-fuel ratio calculating part 33, and the stroke detection information output from the stroke detection permitting part 29. An ignition pulse output part 32 is provided for outputting ignition pulses corresponding to the ignition timing set by the ignition timing calculating part 31 to the ignition coil 11 based on the crank timing information detected by the crank timing detecting part 27.

The engine rotational speed calculating part 26 calculates the rotational speed of the crankshaft as an output shaft of the engine as the engine rotational speed based on the rate of change of the crank angle signal with time. More specifically, the engine rotational speed calculating part 26 calculates an instantaneous value of the engine rotational speed by dividing the phase between two adjacent teeth 23 by the time needed to detect corresponding crank pulses and an average engine rotational speed that is an average movement distance of the teeth 23.

Figure 4:
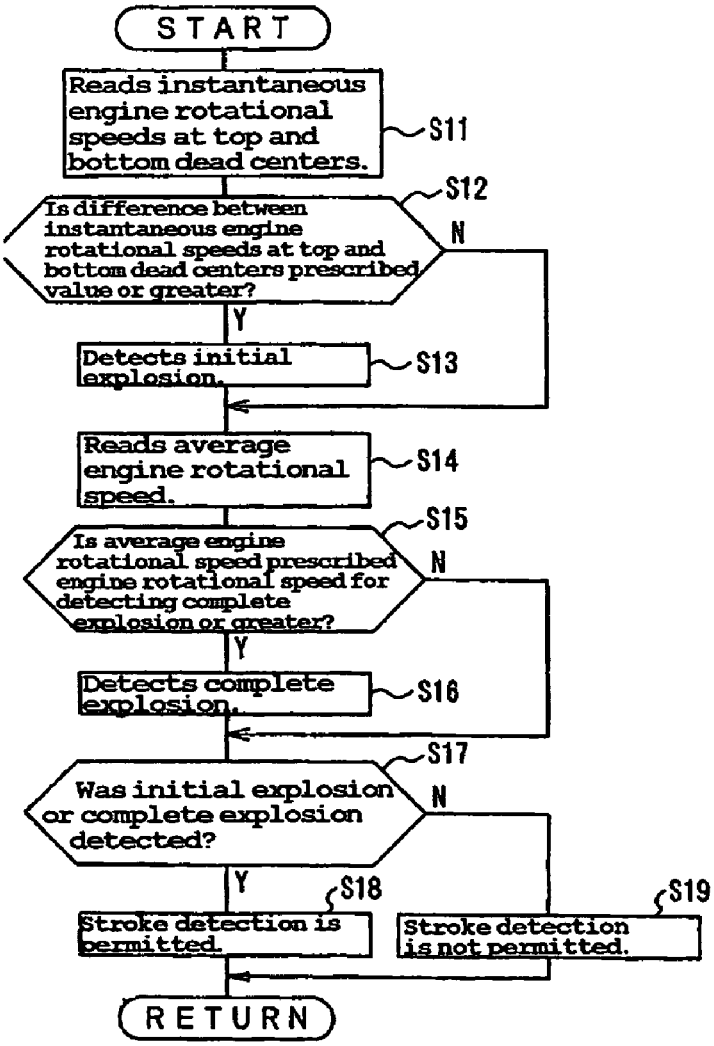
FIG. 4 is a flowchart illustrating an operation performed in the stroke detection permitting part in FIG. 3.

The stroke detection permitting part 29 outputs stroke detection permitting information to the crank timing detecting part 27 according to the operation shown in FIG. 4. As described before, it takes at least two rotations of the crankshaft 3 to detect a stroke based on crank pulses and it is necessary for the crank pulses including the tooth missing part to be stable during that time. In a relatively small displacement, a single-cylinder engine as in this embodiment, however, the rotating state is unstable during cranking as it is called at the time of starting. Thus, the stroke detection is permitted after judgment of the rotating state of the engine is made according to the operation shown in FIG. 4.

The operation shown in FIG. 4 is performed using an input of a crank pulse as a trigger. Although there is provided no step for communication in the flowchart, the information obtained through the operation is accordingly stored in a memory in an overwriting manner and information and programs necessary for the operation are read out from the memory as needed.

At first in this operation, the instantaneous engine speeds at top and bottom dead centers calculated in the engine rotational speed calculating part 26 are read in the step S11.

Then, the process goes to the step S12, in which it is judged whether the difference between the instantaneous engine rotational speeds at top and bottom dead centers read in the step S11 is not smaller than a predetermined prescribed rotational speed for detecting an initial explosion corresponding to a rotational speed at an initial explosion. If the difference between the instantaneous engine rotational speeds is not smaller than the prescribed rotational speed for detecting an initial explosion, the process goes to the step S13. Otherwise, the process goes to the step S14.

In the step S13, an initial explosion is detected and output. Then, the process goes to the step S14.

In the step S14, an average engine rotational speed calculated in the engine rotational speed calculating part 26 is read.

The process then goes to the step S15, in which it is judged whether the average engine rotational speed read in the step S14 is not lower than a predetermined prescribed rotational speed for detecting a complete explosion corresponding to a rotational speed at a complete explosion. If the average engine rotational speed is not lower than the rotational speed for detecting a complete explosion, the process goes to the step S116. Otherwise, the process goes to the step S17.

In the step S16, a complete explosion is detected and output. Then, the process goes to the step S17.

In the step S17, it is judged whether there was an output of an initial explosion detection in the step S13 or whether there was an output of a complete explosion detection in the step S16. If there was an output of an initial explosion detection or complete explosion detection, the process goes to the step S18. Otherwise, the process goes to the step S19.

In the step S18, information that a stroke detection is permitted is output. Then, the process returns to a main program.

In the step S19, information that a stroke detection is not permitted is output. Then, the process returns to the main program.

According to the operation, stroke detection is permitted after an initial explosion has taken place in the engine or the average engine rotational speed reaches a value corresponding to a rotational speed at a complete explosion. Thus, stable crank pulses can be obtained and a stroke can be detected with accuracy.

Figure 5:
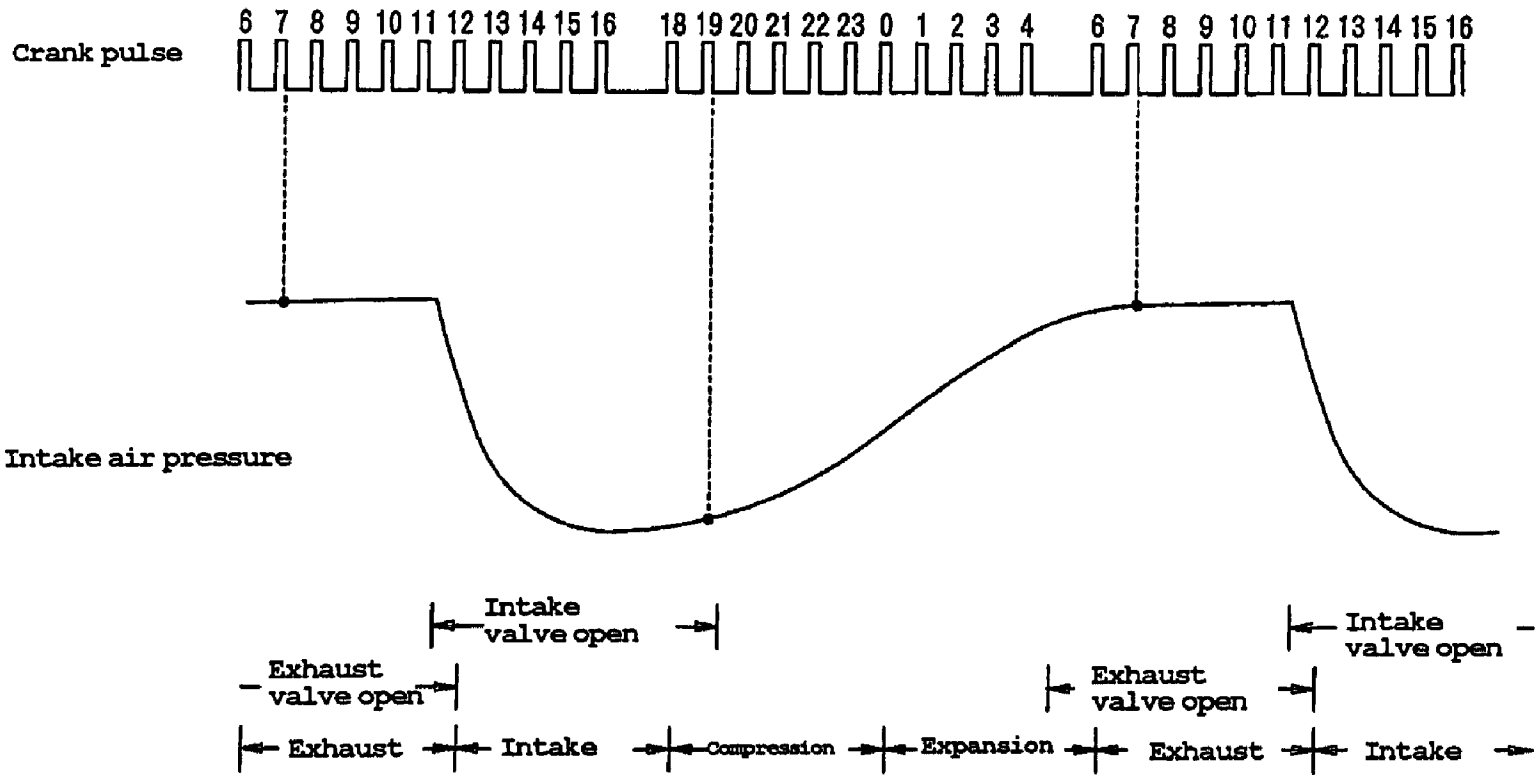
FIG. 5 is an explanatory view illustrating a process of detecting the stroke state from the phase of a crankshaft and the intake air pressure.

The crank timing detecting part 27, detects a stroke based on variations in intake air pressure and a stroke based on variations in the engine rotational speed and outputs information on the stroke state as crank timing information. Here, the principle of detection of a stroke based on variations in the intake air pressure will be described. In a four-stroke engine, the crankshaft and the camshaft are constantly rotated with a prescribed phase difference, so that when crank pulses are read as shown in FIG. 5, the fourth crank pulse after the tooth missing part, namely the crank pulse "9" or "21", represents either an exhaust stroke or a compression stroke. As is well known, during an exhaust stroke, the exhaust valve is opened and the intake valve is closed, so that the intake air pressure is high. However, in an early stage of a compression stroke, the intake air pressure is low because the intake valve is still open or because of the previous intake stroke even if the intake valve is closed. Thus, the crank pulse "21" output when the intake air pressure is low indicates that the cylinder is on a compression stroke, and the cylinder reaches compression top dead center immediately after the crank pulse "0" is obtained. More specifically, when the difference between the intake air pressures at two bottom dead centers is a prescribed negative value or smaller, the cylinder is at bottom dead center after an intake stroke and when the difference is a prescribed positive value or greater, the cylinder is at bottom dead center before an exhaust stroke. When a stroke can be detected as above, it is possible to detect the present stroke state in further detail by interpolating the intervals between the strokes with the rotational speed of the crankshaft.

The engine rotational speed is highest in the expansion stroke in the four strokes: intake, compression, expansion (explosion) and exhaust, followed, in this order, by exhaust stroke, intake stroke and compression stroke. By combining the variations in the engine rotational speed and the phase of the crankshaft represented by crank pulses, a stroke can be detected as in the case with the stroke detection based on variations in the intake air pressure. More specifically, when the difference between the engine rotational speeds at top and bottom dead centers is a prescribed negative value or smaller, the cylinder is at bottom dead center after an intake stroke, and when the difference is a prescribed positive value or greater, the cylinder is at bottom dead center before an exhaust stroke.

Figure 6:
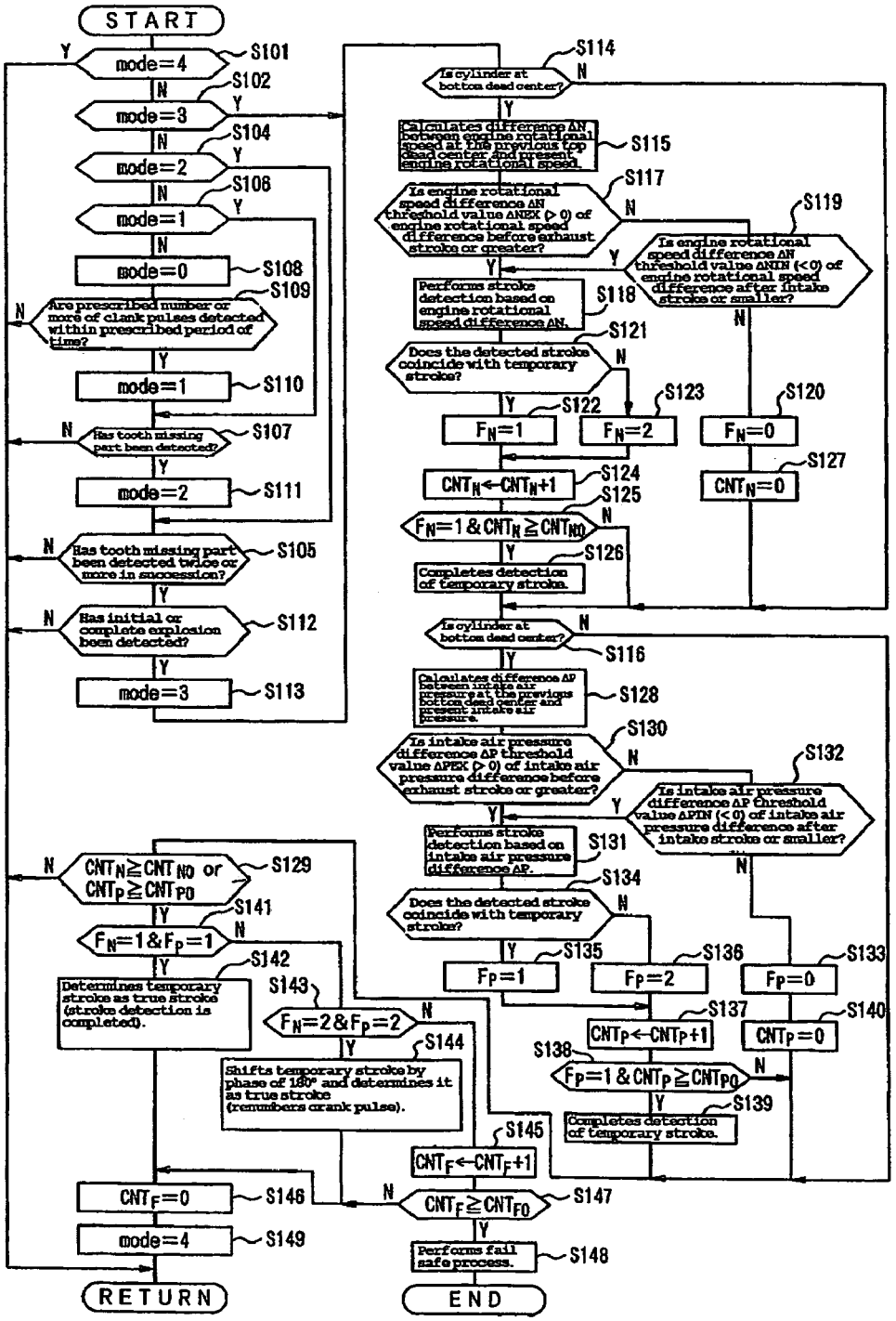
FIG. 6 is a flowchart illustrating an operation performed in the crank timing detecting part in FIG. 3.

Thus, the crank timing detecting part 27 performs an operation shown in FIG. 6 for setting the operation mode and detecting a stroke. The operation shown in FIG. 6 is performed using an input of a crank pulse, for example, as a trigger. Although there is provided no step for communication in the flowchart, the information obtained through the operation is accordingly stored in the memory in an overwriting manner and information and programs necessary for the operation are read out from the memory as needed.

At first in this operation, it is judged whether the operation mode has been set to "4" in the step S101. If the operation mode has been set to "4", the process returns to a main program. Otherwise, the process goes to the step S102.

In the step S102, it is judged whether the operation mode has been set to "3". If the operation mode has been set to "3", the process goes to the step S114. Otherwise, the process goes to the step S104.

In the step S104, it is judged whether the operation mode has been set to "2". If the operation mode has been set to "2", the process goes to the step S105. Otherwise, the process goes to the step S106.

In the step S106, it is judged whether the operation mode has been set to "1". If the operation mode has been set to "1", the process goes to the step S107. Otherwise, the process goes to the step S108.

In the step S108, the operation mode is set to "0". Then, the process goes to the step S109.

In the step S109, it is judged whether a prescribed number or more of crank pulses are detected within a prescribed period of time. If a prescribed number or more of crank pulses are detected within a prescribed period of time, the process goes to the step S110. Otherwise, the process returns to the main program.

In the step S110, the operation mode is set to "1". Then, the process goes to the step S107.

In the step S107, it is judged whether the tooth missing part has been detected. If the tooth missing part has been detected, the process goes to the step S111. Otherwise, the process returns to the main program. When a value obtained by dividing the width $T_2$ of an OFF-part by the average of the widths $T_1$ and $T_3$ of the pulses before and after the OFF-part (the widths $T_{1\ to\ T3}$ are represented by time) is greater than a prescribed value α, the part is judged as the tooth missing part.

In the step S111, the operation mode is set to "2". Then, the process goes to the step S105.

In the step S105, it is judged whether the tooth missing part has been detected twice in succession. If the tooth missing part has been detected twice in succession, the process goes to the step S112. Otherwise, the process returns to the main program.

In the step S112, it is judged whether an initial or a complete explosion in the engine has been detected. If an initial or a complete explosion has been detected, the process goes to the step S113. Otherwise, the process returns to the main program.

In the step S113, the operation mode is set to "3". Then, the process goes to the step S114.

In the step S114, it is judged whether the cylinder is now at bottom dead center based on the state of the crank pulses. If the cylinder is at bottom dead center, the process goes to the step S115. Otherwise, the process goes to the step S116.

In the step S115, an engine rotational speed difference ΔN is calculated. Then, the process goes to the step S117. The engine rotational speed difference ΔN is obtained by subtracting the engine rotational speed at the previous top dead center from the present engine rotational speed.

In the step S117, it is judged whether the engine rotational speed difference ΔN calculated in the step S115 is not smaller than a predetermined positive threshold value $\Delta N_{EX}$ of the engine rotational speed difference before an exhaust stroke. If the engine rotational speed difference ΔN is not smaller than the threshold value $\Delta N_{EX}$ of the engine rotational speed difference before the exhaust stroke, the process goes to the step S118. Otherwise, the process goes to the step S119.

In the step S119, it is judged whether the engine rotational speed difference ΔN calculated in the step S115 is not greater than a predetermined negative threshold value $\Delta N_{IN}$ of the engine rotational speed difference after the intake stroke. If the engine rotational speed difference ΔN is not greater than the threshold value $\Delta N_{IN}$ of the engine rotational speed difference after the intake stroke, the process goes to the step S118. Otherwise, the process goes to the step S120.

In the step S118, stroke detection based on the engine rotational speed difference ΔN is performed as described before. Then, the process goes to the step S121.

In the step S121, it is judged whether the stroke detected in the step S118 coincides with a temporary stroke set before the stroke was detected. If the detected stroke coincides with the temporary stroke, the process goes to the step S122. Otherwise, the process goes to the step S123.

In the step S122, a flag $F_N$ for the stroke detection based on the engine rotational speed difference is set to "1". Then, the process goes to the step S124.

In the step S123, the flag $F_N$ for stroke detection based on the engine rotational speed difference is set to "2". Then, the process goes to the step S124.

In the step S124, a counter $CNT_N$ for the stroke detection based on the engine rotational speed difference is incremented. Then, the process goes to the step S125.

In the step 125, it is judged whether the flag $F_N$ for stroke detection based on the engine rotational speed difference has been set to "1" and whether the counter $CNT_N$ for stroke detection based on the engine rotational speed difference is at a value which is not smaller than a predetermined prescribed value $CNT_{N0}$. If the flag $F_N$ for the stroke detection based on the engine rotational speed difference has been set to "1" and the counter $CNT_N$ for the stroke detection based on the engine rotational speed difference is at a value which is not smaller than the prescribed value $CNT_{N0}$, the process goes to the step S126. Otherwise, the process goes to the step S116.

In the step S126, the detection of a temporary stroke based on an engine rotational speed difference is regarded as having been completed. Then, the process goes to the step S116.

In the step S120, the flag $F_N$ for the stroke detection based on the engine rotational speed difference is reset to "0". Then, the process goes to the step S127.

In the step S127, the counter $CNT_N$ for the stroke detection based on the engine rotational speed difference is cleared to "0". Then, the process goes to the step S116.

In the step S116, it is judged whether the cylinder is at bottom dead center based on the state of the crank pulses. If the cylinder is at bottom dead center, the process goes to the step S128. Otherwise, the process goes to the step S129.

In the step S128, an intake air pressure difference ΔP is calculated. Then, the process goes to the step S130. The intake air pressure difference ΔP is obtained by subtracting the intake air pressure at the previous bottom dead center from the present intake air pressure.

In the step S130, it is judged whether the intake air pressure difference ΔP calculated in the step S128 is not smaller than a predetermined positive threshold value $\Delta P_{EX}$ of the intake air pressure difference before the exhaust stroke. If the intake air pressure difference ΔP is not smaller than the threshold value $\Delta P_{EX}$ of the intake air pressure difference before the exhaust stroke, the process goes to the step S131. Otherwise, the process goes to the step S132.

In the step S132, it is judged whether the intake air pressure difference ΔP calculated in the step S128 is not greater than a predetermined negative threshold value $\Delta P_{IN}$ of the intake air pressure difference after the intake stroke. If the intake air pressure difference ΔP is not greater than the threshold value $\Delta P_{IN}$ of the intake air pressure difference after the intake stroke, the process goes to the step S131. Otherwise, the process goes to the step S133.

In the step S131, the stroke detection based on the intake air pressure difference ΔP is performed as described before. Then, the process goes to the step S134.

In the step S134, it is judged whether the stroke detected in the step S131 coincides with a temporary stroke set before the stroke was detected. If the detected stroke coincides with the temporary stroke, the process goes to the step S135. Otherwise, the process goes to the step S136.

In the step S135, a flag $F_P$ for the stroke detection based on the intake air pressure difference is set to "1". Then, the process goes to the step S137.

In the step S136, the flag $F_P$ for the stroke detection based on the intake air pressure difference is set to "2". Then, the process goes to the step S137.

In the step S137, a counter $CNT_P$ for the stroke detection based on the intake air pressure difference is incremented. Then, the process goes to the step S138.

In the step S138, it is judged whether the flag $F_P$ for the stroke detection based on the intake air pressure difference has been set to "1" and whether the counter $CNT_P$ for the stroke detection based on the intake air pressure difference is at a value which is not smaller than a predetermined prescribed value $CNT_{P0}$. If the flag $F_P$ for the stroke detection based on the intake air pressure difference has been set to "1" and the counter $CNT_P$ for the stroke detection based on the intake air pressure difference is at a value which is not smaller than the prescribed value $CNT_{P0}$, the process goes to the step S139. Otherwise, the process goes to the step S129.

In the step S139, the detection of a temporary stroke based on an intake air pressure difference is regarded as having been completed. Then, the process goes to the step S129.

In the step S133, the flag $F_P$ for the stroke detection based on the intake air pressure difference is reset to "0". Then, the process goes to the step S140.

In the step S140, the counter $CNT_P$ for the stroke detection based on the intake air pressure difference is cleared to "0". Then, the process goes to the step S129.

In the step S129, it is judged whether the counter $CNT_N$ for the stroke detection based on the engine rotational speed difference is at a value which is not lower than the prescribed value $CNT_{N0}$ or the counter $CNT_P$ for the stroke detection based on the intake air pressure difference is at a value which is not lower than the prescribed value $CNT_{P0}$. If either is the case, the process goes to the step S141. Otherwise, the process returns to the main program.

In the step S141, it is judged whether the flag $F_N$ for the stroke detection based on the engine rotational speed difference has been set to "1" and whether the flag $F_P$ for the stroke detection based on the intake air pressure difference has been set to "1". When both the flags have been set to "1", the process goes to the step S142. Otherwise, the process goes to the step S143.

In the step S143, it is judged whether the flag $F_N$ for the stroke detection based on the engine rotational speed difference has been set to "2" and whether the flag $F_P$ for the stroke detection based on the intake air pressure difference has been set to "2". When both the flags have been set to "2", the process goes to the step S144. Otherwise, the process goes to the step S145.

In the step S142, the temporary stroke set before the stroke was detected is determined as the true stroke as it is and the stroke detection is completed. Then, the process goes to the step S146.

In the step S144, the temporary stroke is shifted by a phase of 360°, namely by a phase corresponding to a rotation of the crankshaft, and determined as the true stroke. More specifically, the crank pulse "12" is renumbered. Then, the process goes to the step S146.

In the step S145, a fail counter $CNT_F$ is incremented. Then, the process goes to the step S146.

In the step S146, it is judged whether the fail counter $CNT_F$ is at a value which is not lower than a predetermined prescribed value $CNT_{F0}$. If the fail counter $CNT_F$ is at a value which is not lower than the prescribed value $CNT_{F0}$, the process goes to the step S148. Otherwise, the process goes to the step S146.

In the step S146, the fail counter $CNT_F$ is cleared to "0". Then, the process goes to the step S149.

In the step S149, the operation mode is set to "4". Then, the process returns to the main program.

In the step S148, a prescribed fail safe process is performed. Then, the program is ended. Examples of the fuel safe process include lowering the engine torque gradually by decreasing the frequency of ignition gradually, shifting the ignition in the cylinder to the lag side gradually, or closing the throttle quickly at first and then slowly for an indication of abnormality.

According to the operation, at the start of the engine or the like, the operation mode is set to "1" when a prescribed number or more of crank pulses are detected within a prescribed period of time, and set to "2 when the tooth missing part is detected. Then, when the tooth missing part is detected twice in succession and the stroke detection permitting part 29 detects an initial or a complete explosion and permits stroke detection, the operation mode is set to "3". Then, as described before, it is judged whether the difference ΔN between the engine rotational speeds at top and bottom dead centers is not smaller than the threshold value $\Delta N_{EX}$ of the engine rotational speed difference before the exhaust stroke or not greater than the threshold value $\Delta N_{IN}$ of the engine rotational speed difference after the intake stroke to perform the stroke detection based on an engine rotational speed difference. Simultaneously, it is judged whether the difference ΔP between the intake air pressures at two bottom dead centers is not smaller than the threshold value $\Delta P_{EX}$ of the intake air pressure difference before the exhaust stroke or not greater than the threshold value $\Delta P_{IN}$ of the intake air pressure difference after the intake stroke to perform stroke detection based on an intake air pressure difference. Then, either of the stroke detections is repeated a prescribed number $CNT_{NO}$ or $CNT_{PO}$ of times. Then, when the detected stroke coincides with the temporary stroke, namely, when the stroke detection flag $F_N$ or $F_P$ is set to "1", the temporary detection is completed.

Moreover, the stroke detection based on an engine rotational speed difference ΔN is repeated at least a prescribed value $CNT_{NO}$ of times or the stroke detection based on an intake air pressure difference ΔP is repeated at least a prescribed value $CNT_{PO}$ of times. Then, when the temporary stroke coincides with the detected stroke, namely the flag $F_N$ for the stroke detection based on the engine rotational speed difference is set to "1" as a result of the stroke detection based on an engine rotational speed difference ΔN and when the temporary stroke coincides with the detected stroke, namely the flag $F_P$ for the stroke detection based on the intake air pressure difference is set to "1" as a result of the stroke detection based on an intake air pressure difference ΔP, the temporary stroke is determined as the true stroke as it is. Thereby, the stroke detection is completed. Then, the operation mode is set to "4". When the temporary stroke differs from the detected stroke, namely the flag $F_N$ for stroke detection based on the engine rotational speed difference is set to "2" as a result of the stroke detection based on an engine rotational speed difference ΔN and when the temporary stroke differs from the detected stroke, namely the flag $F_P$ for stroke detection based on the intake air pressure difference is set "2"as a result of the stroke detection based on an intake air pressure difference ΔP, the temporary stroke is shifted by a phase of 360° and determined as the true stroke. Thereby, the stroke detection is completed. Then, the operation mode is set to "4". In shifting the phase of the stroke, a crank pulse is renumbered.

Figure 7:
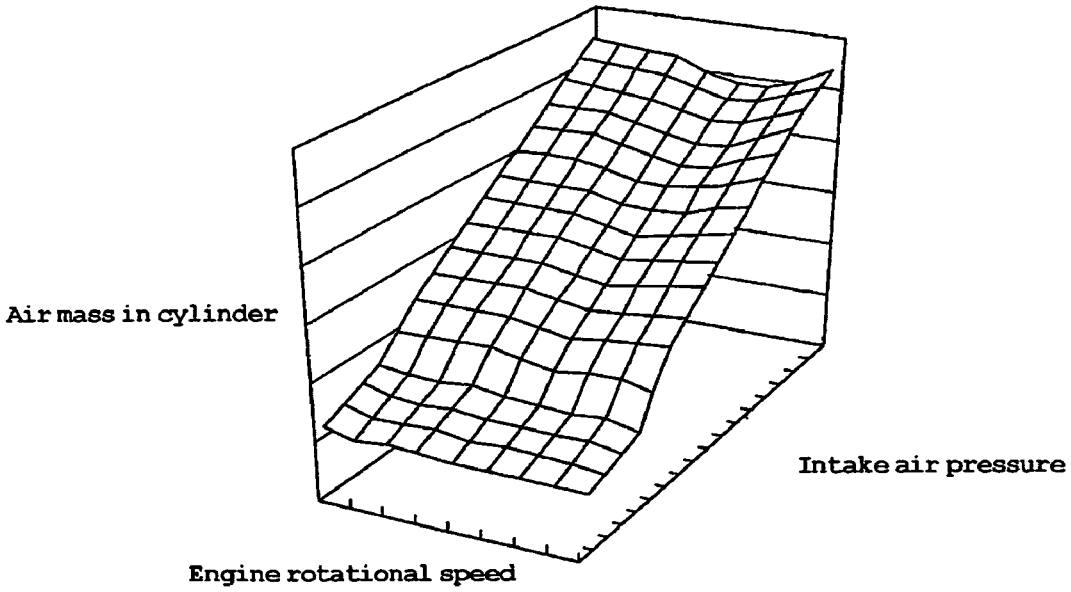
FIG. 7 is a map stored in an in-cylinder air mass calculating part for use in calculating the air mass in a cylinder.

The in-cylinder air mass calculating part 28 has a three-dimensional map as shown in FIG. 7 for use in calculating the air mass in the cylinder based on an intake air pressure signal and an engine rotational speed calculated in the engine rotational speed calculating part 26. The three-dimensional map for use in calculating the air mass in the cylinder can be obtained only by measuring the air mass in the cylinder while changing the intake air pressure with the engine rotated at a prescribed rotational speed. The measurement can be conducted with a relatively simple experiment, so that the map can be organized with ease. The map could be organized with an advanced engine simulation system. The air mass in the cylinder, which is changed with the engine temperature, may be corrected with the cooling water temperature (engine temperature) signal.

Figure 8:
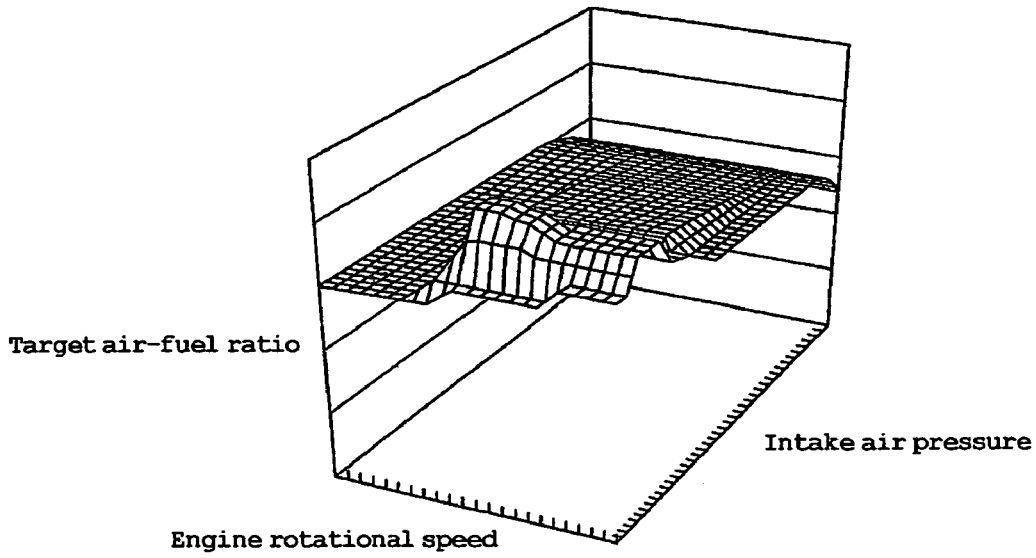
FIG. 8 is a map stored in a target air-fuel ratio calculating part for use in calculating a target air-fuel ratio.

The target air-fuel ratio calculating part 33 has a three-dimensional map as shown in FIG. 8 for use in calculating a target air-fuel ratio based on an intake air pressure signal and an engine rotational speed calculated in the engine rotational speed calculating part 26. The three-dimensional map can be organized on paper to some extent. In general, the air-fuel ratio is correlated with the torque. When the air-fuel ratio is low, namely, when the amount of fuel is large and the amount of air is small, the torque increases but the efficiency decreases. Whereas, when the air-fuel ratio is high, namely, when the amount of fuel is small and the amount of air is large, the torque decreases but the efficiency increases. The state where the air-fuel ratio is low is called "rich" and the state where the air-fuel ratio is high is called "lean". The leanest state is one often referred to as "stoichiometry", where the ideal air-fuel ratio at which complete combustion of gasoline takes place, namely, an air-fuel ratio of 14.7 is attained.

The engine rotational speed indicates the operating condition of the engine. In general, the air-fuel ratio is increased when the engine rotational speed is high and decreased when the engine rotational speed is low. This is to enhance torque responsiveness in the low rotational speed range and to enhance rotation responsiveness in the high rotational speed range. The intake air pressure indicates the engine load such as the throttle opening. In general, when the engine load is large, namely, when the throttle opening is large and the intake air pressure is high, the air-fuel ratio is decreased and when the engine load is small, namely, when the throttle opening is small and the intake air pressure is low, the air-fuel ratio is increased. This is because the torque is important when the engine load is large and efficiency is important when the engine load is small.

As above, the target air-fuel ratio has a physical meaning easy to understand and thus can be set to some extent in accordance with the required engine output characteristics. It is needless to say that the air-fuel ratio may be tuned in accordance with the output characteristics of an actual engine.

Figure 9:
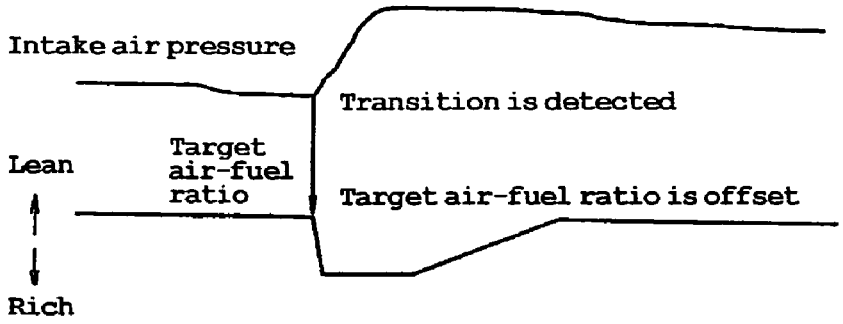
FIG. 9 is an explanatory view illustrating the operation of a transition correction part.

The target air-fuel ratio calculating part 33 has a transition correction part 29 for detecting transitions, more specifically, the accelerating state and decelerating state of the engine based on an intake air pressure signal and correcting the target air-fuel ratio in response thereto. For example, as shown in FIG. 9, the change of the intake air pressure is also a result of an operation of the throttle, so that an increase of the intake air pressure indicates that the throttle is opened to accelerate the vehicle, namely, the engine is accelerating. When such an accelerating state is detected, the target air-fuel ratio is set to the rich side temporarily and then returned to the original target value. As a method to return the air-fuel ratio to the original value, there may be employed any existing method, such as a method in which a weighing coefficient of a weighted means of the air-fuel ratio set to the rich side during the transition and the original target air-fuel ratio is gradually changed. When a decelerating state is detected, the target air-fuel ratio may be set to the lean side rather than the original target air-fuel ratio to attain high efficiency.

Figure 10:
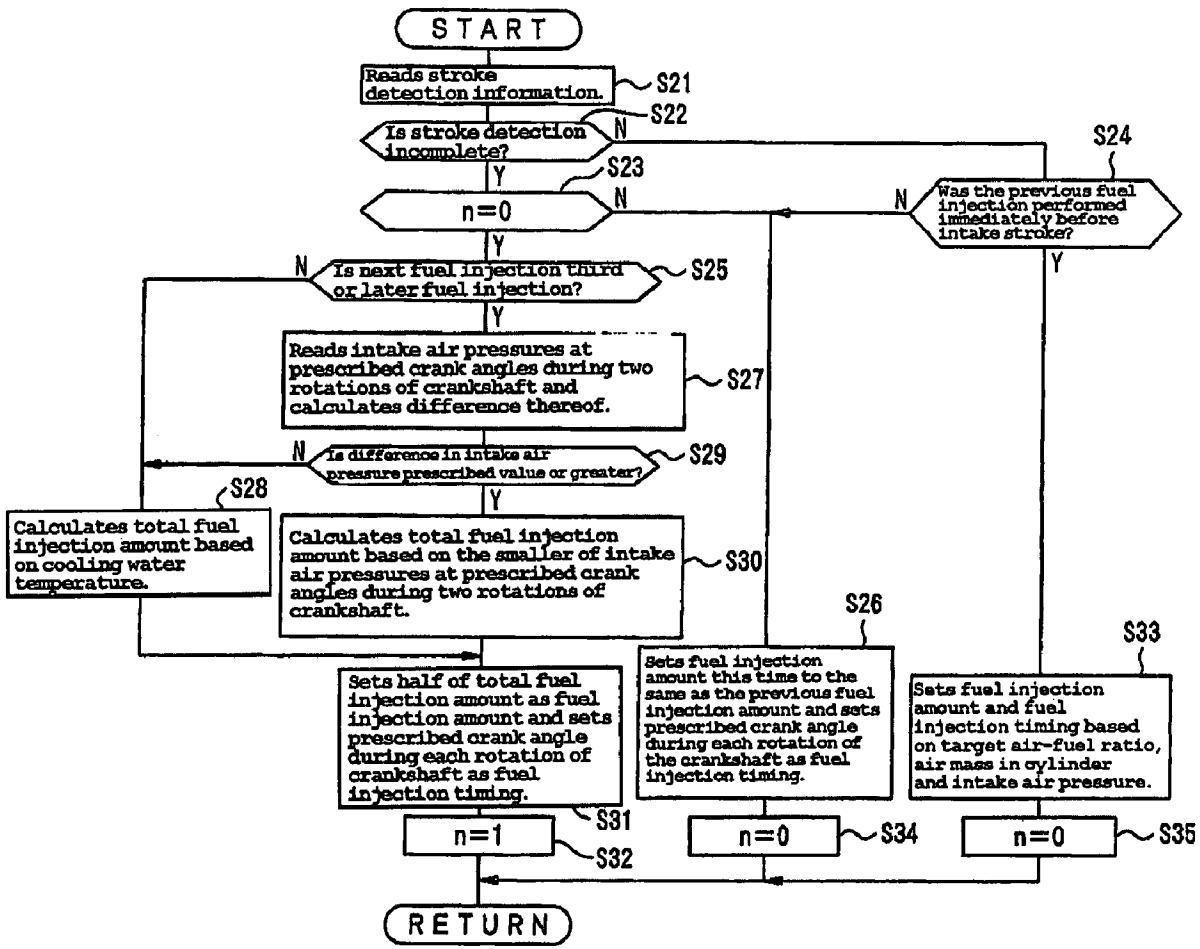
FIG. 10 is a flowchart illustrating an operation performed in the fuel injection amount calculating part in FIG. 3.

The fuel injection amount calculating part 34 calculates and sets the fuel injection amount and fuel injection timing at the start and during a normal operation of the engine according to an operation shown in FIG. 10. The operation shown in FIG. 10 is performed using an input of a crank pulse as a trigger. Although there is provided no step for communication in the flowchart, the information obtained through the operation is accordingly stored in the memory in an overwriting manner and information and programs necessary for the operation are read out from the memory as needed.

At first in this operation, stroke detection information output from the stroke detection permitting part 29 is read in the step S21.

Then, the process goes to the step S22, in which it is judged whether the stroke detection by the crank timing detecting part 27 has not been completed (the operation mode has been set to "3"). When the stroke detection has not been completed, the process goes to the step S23. Otherwise, the process goes to the step S24.

In the step S23, it is judged whether a fuel injection time counter n is at "0". When the fuel injection time counter n is at "0", the process goes to the step S25. Otherwise, the process goes to the step S26.

In the step S25, it is judged whether the next fuel injection is the third or later fuel injection after the start of the engine. When the next fuel injection is the third or later fuel injection, the process goes to the step S27. Otherwise the process goes to the step S28.

Figure 2:
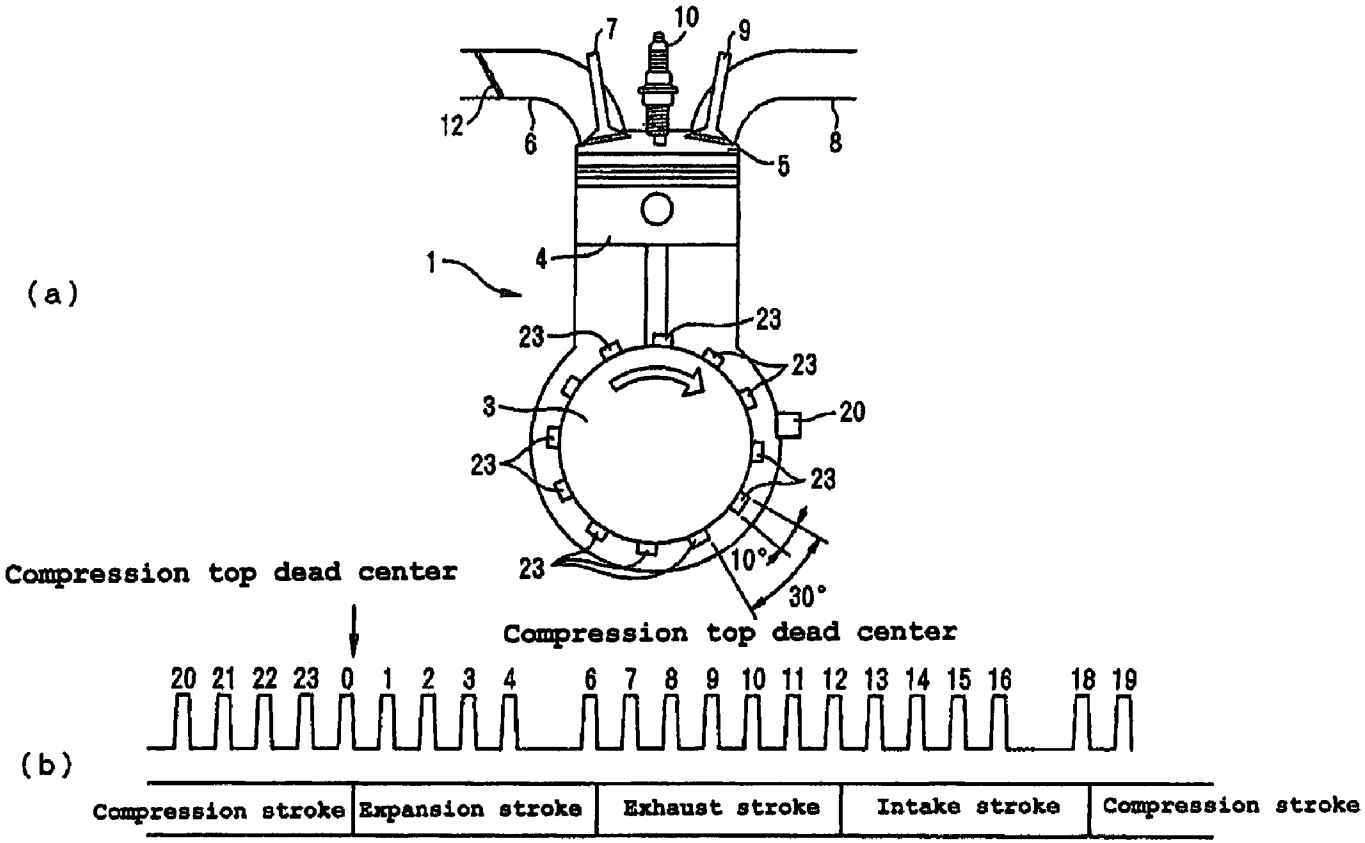
FIGS. 2(*a*) and 2(*b*) are an explanatory views illustrating a principle of outputting crank pulses in the engine in FIG. 1.

In the step S27, the intake air pressures at predetermined prescribed crank angles during two rotations of the crankshaft, the intake air pressures at the time when the crank pulses "6" and "18" shown in FIG. 2 and FIG. 5 are generated in this embodiment, are read out from an intake air pressure recording part (not shown), and the difference between the intake air pressures is calculated. Then, the process goes to the step S29.

In the step S29, it is judged whether the difference in intake air pressure calculated in the step S28 is not smaller than a prescribed value which is large enough to discriminate a stroke to some extent. When the difference in intake air pressure is not smaller than the prescribed value, the process goes to the step S30. Otherwise, the process goes to the step S28.

In the step S30, a total fuel injection amount is calculated based on the smaller of the two intake air pressures during two rotations of the crankshaft read in the step S27. Then, the process goes to the step S31.

In the step S28, the cooling water temperature, namely the engine temperature is read and a total fuel injection amount is calculated based on the cooling water temperature. For example, as the cooling water temperature is lowered, the fuel injection amount is increased. Then, the process goes to the step S31. The total fuel injection amount calculated in the step S28 or the step S30 is the amount of fuel to be injected once every cycle, namely once every two rotation of the crankshaft, before the intake stroke. Thus, when a stroke has already been detected, the engine can be rotated properly according to the cooling water temperature, namely the engine temperature, by injecting an amount of fuel calculated based on the cooling water temperature once before each intake stroke.

In the step S31, half of the total fuel injection amount set in the step S30 is set as the amount of fuel to be injected this time and the fuel injection timing is set at a prescribed crank angle during each rotation of the crankshaft, at the time when the crank pulse "10" or "22" shown in FIG. 2 and FIG. 5 falls in this embodiment. Then, the process goes to the step S32.

In the step S32, the fuel injection time counter is set to "1". Then, the process returns to a main program.

In the step S24, it is judged whether the previous fuel injection was performed immediately before an intake stroke. If the previous fuel injection was performed immediately before an intake stroke, the process goes to the step S33. Otherwise, the process goes to the step S26.

In the step S26, the fuel injection amount this time is set to the same as the previous fuel injection amount and the fuel injection timing is set at a prescribed crank angle during each rotation of the crankshaft in the same manner as in the step S31. Then, the process goes to the step S34.

In the step S34, the fuel injection time counter is set to "0". Then, the process returns to the main program.

In the step S33, the fuel injection amount and fuel injection timing for normal operation are set based on a target air-fuel ratio, an air mass in the cylinder, and an intake air pressure. Then, the process goes to the step S35. More specifically, since the amount of fuel to be supplied into the cylinder can be obtained by dividing the air mass calculated in the in-cylinder air mass calculating part 28 by the target air-fuel ratio calculated in the target air-fuel ratio calculating part 33, the fuel injection period can be obtained by multiplying the amount of fuel to be supplied into the cylinder by the flow characteristic of the injector 13, for example. The fuel injection amount and the fuel injection timing can be calculated from the fuel injection period.

In the step S34, the fuel injection time counter is set to "0". Then, the process returns to the main program.

According to the operation, when the crank timing detecting part 27 has not completed stroke detection (the operation mode has been set to "3"), half of the total fuel injection amount, with which the engine can be rotated properly if it is injected before the intake stroke in each cycle, is injected at a prescribed crank angle once every rotation of the crankshaft. Thus, there is a possibility that only a half of the required amount of fuel is supplied in the first intake stroke after the start of cranking at the start of the engine as described later. However, it is possible to reliably produce an explosion to start the engine even if it may be weak when ignition is made at compression top dead center or in the vicinity thereof. When the required amount of fuel is supplied in the first intake stroke after the start of cranking, namely when fuel which has been supplied by two injections, each performed during one rotation of the crankshaft, can be sucked into the cylinder, it is possible to obtain a sufficient explosive power to start the engine reliably.

Even when a stroke has been detected, when the previous fuel injection was performed not immediately before an intake stroke, for example, performed before an exhaust stroke, only a half of the required amount of fuel has been injected. Thus, by injecting the same amount of fuel as the previous injection again, the amount of fuel required to produce a sufficient explosive power to start the engine is supplied into the cylinder during the next intake stroke.

Moreover, when the stroke detection has not been completed, the intake air pressures at predetermined crank angles during two rotations of the crankshaft are read. More specifically, the intake air pressures at the time when the crank pulses "6" and "18" shown in FIG. 2 and FIG. 5 are generated, namely, the intake air pressures during an intake stroke and an expansion stroke are read. Then, the difference between the intake air pressures is calculated. As described before, unless the throttle valve is widely open, there is a large difference between the intake air pressures during an intake stroke and an expansion stroke. When the calculated intake air pressure difference is not smaller than a prescribed value which is large enough to detect a stroke, the smaller of the two intake air pressures can be regarded as an intake air pressure during an intake stroke. Then, by setting a total fuel injection amount based on the intake air pressure, which reflects the throttle opening to some extent, it is possible to obtain an increase in engine rotational speed according to the throttle opening.

When the difference between the intake air pressures at predetermined crank angles during two rotations of the crankshaft is smaller than the prescribed value or when fuel is injected immediately after the start of the engine, a total fuel injection amount is set based on the cooling water temperature, namely the engine temperature. Thereby, it is at least possible to start the engine reliably against friction.

In this embodiment, prior to the operation shown in FIG. 10, a starting asynchronous injection, by which a certain amount of fuel is injected regardless of the crank pulse, is performed when temporary numbers are attached to the crank pulses while the operation mode is "1".

Figure 11:
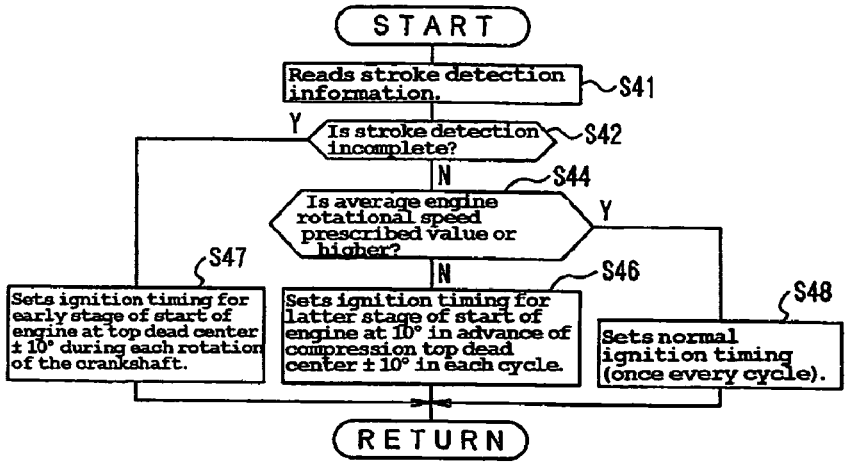
FIG. 11 is a flowchart illustrating an operation performed in the ignition timing calculating part in FIG. 3.

The ignition timing calculating part 31 calculates and sets the ignition timings at the start and during normal operation of the engine according to the operation shown in FIG. 11. The operation shown in FIG. 11 is performed using an input of a crank pulse as a trigger. Although there is provided no step for communication in the flowchart, the information obtained through the operation is accordingly stored in the memory in an overwriting manner and information and programs necessary for the operation are read out from the memory as needed.

At first in this operation, stroke detection information output from the stroke detection permitting part 29 is read in the step S41.

Then, the process goes to the step S42, in which it is judged whether the stroke detection by the crank timing detecting part 27 has not been completed (the operation mode has been set to "3"). If the stroke detection has not been completed, the process goes to the step S47. Otherwise, the process goes to the step S44.

In the step S47, the ignition timing for the early stage of the start of the engine is set at top dead center (either compression top dead center or exhaust top dead center will do) during each rotation of the crankshaft, namely at the fall of the crank pulse "0" or "12" in FIG. 2 or FIG. 5 ± a crankshaft rotational angle of 10°. This is because the engine rotational speed is low and unstable after the start of cranking and before an explosive power of the initial explosion is obtained at the start of the engine. Then, the process returns to a main program. The ignition timing is determined taking the electrical or mechanical responsiveness into consideration. Substantially, the ignition is performed simultaneously with the fall of the pulse "0" or "12" in FIG. 2 or FIG. 5.

In the step S44, it is judged whether the average engine rotational speed is not lower than a prescribed value. When the average engine rotational speed is not lower than the prescribed value, the process goes to the step S48. Otherwise, the process goes to the step S46.

Figure 12:
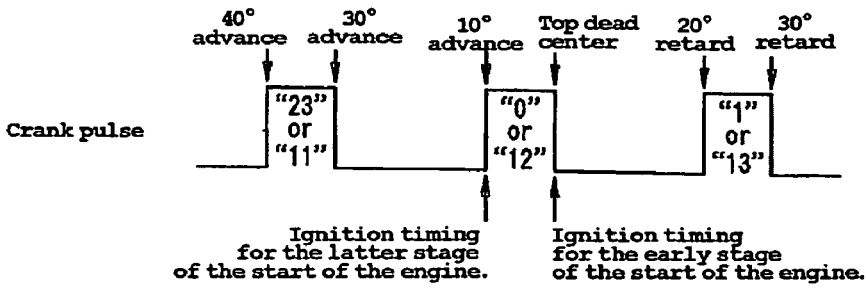
FIG. 12 is an explanatory view of ignition timing set in the operation shown in FIG. 10.

In the step S46, the ignition timing for the latter stage of the start of the engine is set at 10° in advance of compression top dead center in each cycle, namely at the rise of the pulse "0" in FIG. 12 ± a crankshaft rotational angle of 10°. This is because the engine rotational speed is relatively high (but still unstable) after an explosive power of the initial explosion is obtained at the start of the engine. Then, the process returns to a main program. The ignition timing is determined taking the electrical or mechanical responsiveness into consideration. Substantially, the ignition is performed simultaneously with the rise of the pulse "0" or "12" in FIG. 2 or FIG. 5.

In the step S48, the ignition timing is set to the normal ignition timing so that ignition can be made once every cycle. Then, the process returns to the main program. In general, the torque is highest when ignition is made slightly in advance of top dead center. Thus, the ignition timing is adjusted with respect to the normal ignition timing in response to the driver's intention of accelerating which is represented by the intake air pressure.

In this operation, at the start of cranking before completion of the stroke detection and an initial explosion, namely in the early stage of the start of the engine, the ignition timing is set at a point in the vicinity of top dead center during each rotation of the crankshaft in addition to the fuel injection during each rotation of the crankshaft to prevent reverse rotation of the engine and to start the engine reliably. Even after a stroke has been detected, about 10° in advance of compression top dead center, at which a relatively high torque can be obtained, is set as the ignition timing for the latter stage of the start of the engine to stabilize the engine rotational speed at a relatively high level until the engine rotational speed reaches a prescribed value or higher.

As described above, in this embodiment, the air mass in the cylinder is calculated based on the intake air pressure and the operating condition of the engine according to a three-dimensional in-cylinder air mass map stored in advance and a target air-fuel ratio is calculated based on the intake air pressure and the operating condition of the engine according to a target air-fuel ratio map stored in advance, and then the fuel injection amount can be calculated by dividing the air mass in the cylinder by the target air-fuel ratio. Thus, the control can be easy and precise. Also, since the in-cylinder air mass map is easy to measure and the target air-fuel ratio map is easy to organize, the maps can be organized with ease. Also, there is no need to provide a throttle opening sensor or a throttle position sensor for detecting the engine load.

Also, since a transition, namely, an accelerating state or a decelerating state is detected based on the intake air pressure and the target air-fuel ratio is corrected based thereon, it is possible to shift the engine output characteristics during acceleration or deceleration from ones set according to the target air-fuel ratio map to ones required by the driver or ones close to the driver's feeling.

Also, since the engine rotational speed is detected based on the phase of the crankshaft, it is possible to detect the engine rotational speed with ease. Also, it is possible to eliminate a cam sensor, which is expensive and large, when the stroke state is detected based on, for example, the phase of the crankshaft, not with a cam sensor.

In this embodiment, in which no cam sensor is used, the detection of the phase of the crankshaft and a stroke is important. In this embodiment, in which a stroke is detected based on crank pulses and an intake air pressure, the stroke detection takes at least two rotations of the crankshaft. However, it is impossible to know during which stroke the engine is stopped, namely it is impossible to know from which stroke cranking is started. Thus, in this embodiment, between the start of cranking and the completion of the stroke detection, fuel is injected at a prescribed crank angle during each rotation of the crankshaft and ignition is made at a point in the vicinity of compression top dead center during each rotation of the crankshaft using the crank pulses. After a stroke has been detected, although fuel injection which can attain a target air-fuel ratio in accordance with the throttle opening is performed once every cycle, ignition is made at about 10° in advance of compression top dead center using the crank pulses until the engine rotational speed becomes a prescribed value or higher so that a large torque can be generated.

As described above, in this embodiment, fuel is injected at a prescribed crank angle once every rotation of the crankshaft and ignition is made in the vicinity of compression top dead center once every rotation of the crankshaft before a stroke is detected. Thus, it is possible to produce an initial explosion reliably although it may be weak and it is possible to prevent reverse rotation of the engine. When ignition is made in advance of compression top dead center before an initial explosion is produced, the engine may rotate in reverse. After a stroke has been detected, fuel injection and ignition are performed once every cycle. The ignition is performed at about 10° in advance of compression top dead center to increase the engine rotational speed quickly.

If fuel injection and ignition are performed once every cycle, namely once every two rotations of the crankshaft, before a stroke is detected, a reliable initial explosion cannot be produced when the fuel injection is performed after intake or when the ignition is made at a point other than compression top dead center. Namely, the engine may or may not be started smoothly. If fuel is injected once every rotation of the crankshaft after a stroke has been detected, fuel must continue to be injected in a motorcycle, in which the engine is used in a high rotational speed range, and the dynamic range of the injector is limited. Also, continuing ignition once every rotation of the crankshaft after a stroke has been detected is a waste of energy.

Also, stroke detection based on a difference in engine rotational speed and stroke detection based on a difference in intake air pressure are simultaneously performed, and when the results of the stroke detections coincide with each other, the stroke detection is completed. Thus, the low reliability of each detection method can be compensated, making stroke detection with high reliability possible.

Figure 13:
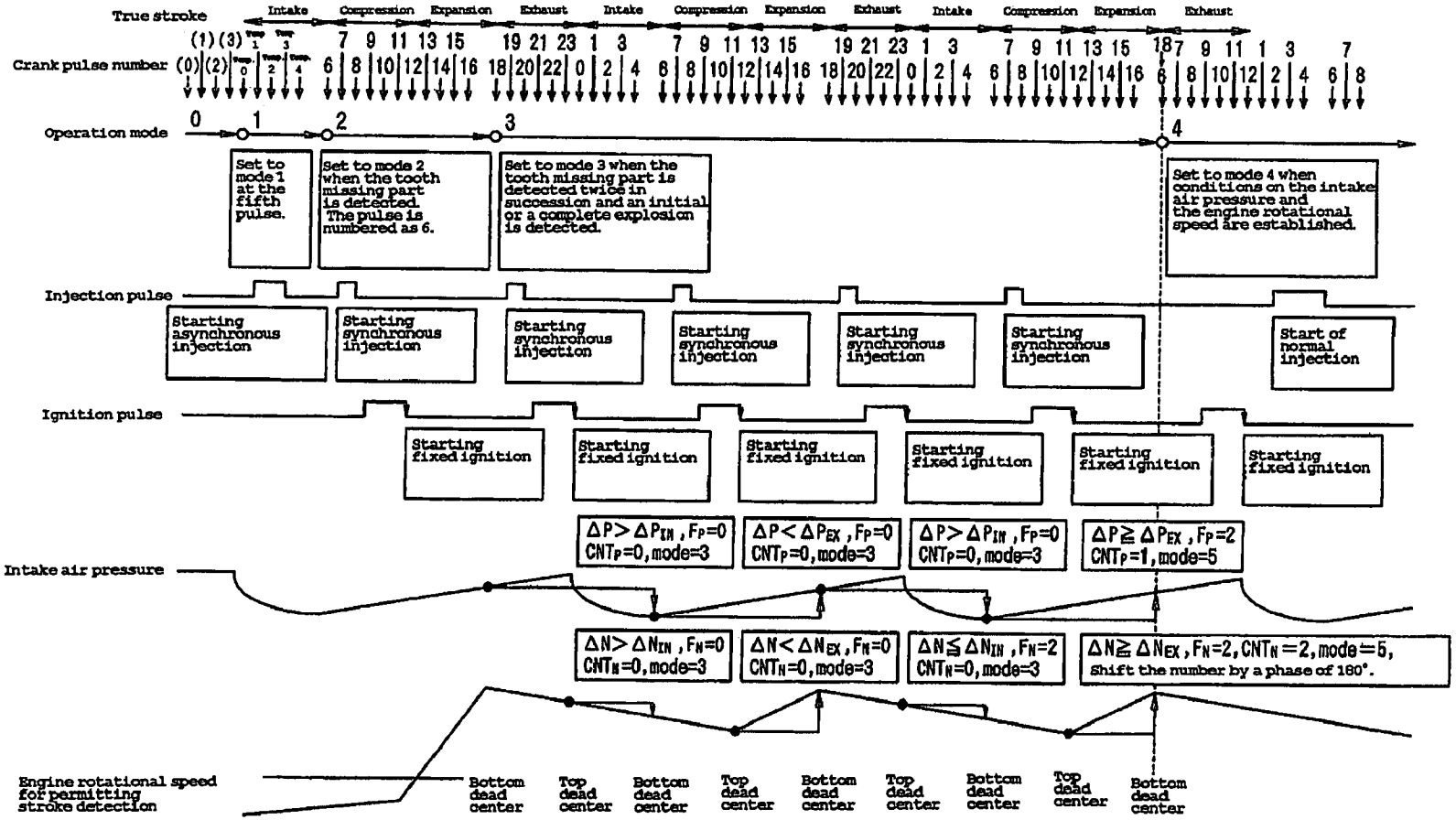
FIG. 13 is an explanatory view illustrating an operation at a start of the engine by the operation shown in FIG. 3.

FIG. 13 shows the variation in crank pulses (only the numbers thereof are shown), operation mode, injection pulses, intake air pressure and engine rotational speed with time at the time when the engine is rotated from exhaust top dead center with a starter motor. In this simulation, the prescribed count-up value $CNT_{N0}$ and $CNT_{P0}$ of the stroke detection counters $CNT_N$ and $CNT_P$ are both "2". The crank pulse numbers immediately after the start of rotation are mere count values. In this embodiment, the operation mode is set to "1" when five crank pulses are detected. When the operation mode is set to "1", temporary numbers "temp. 0, temp. 1, . . . " are attached to the crank pulses. When the tooth missing part is detected, the operation mode is set to "2". After the operation mode has been set to "2", the crank pulse after the tooth missing part is numbered as "6". As described before, the crank pulse number "6" should be attached to a crank pulse indicating bottom dead center after explosion. However, a stroke has not been detected yet here and the number is attached as a temporary stroke. In this embodiment, since the engine is started from exhaust top dead center, the number "6" of the crank pulse is incorrect. When the tooth missing part is detected twice in succession and an initial or a complete explosion is detected, the operation mode is set to "3".

In this embodiment, when temporary numbers are attached to the crank pulses while the operation mode is "1", a certain amount of fuel is injected by the starting asynchronous injection as described before. Also, according to the operation for setting a fuel injection amount and fuel injection timing, when a stroke has not been detected (the operation mode is "2" or "3"), half of the amount of fuel necessary for one cycle is injected at a prescribed crank angle once every rotation of the crankshaft, more specifically, at the time when the crank pulse "7" or "19" is generated. Also, according to the operation for setting ignition timing, when the stroke detection has not been completed (the operation mode is "2" or "3"), ignition pulses are generated so that ignition can be made at a prescribed crank angle once every rotation of the crankshaft, more specifically, at the time when the crank pulse "0" or "12" is generated (more specifically, ignition is made when the ignition pulse falls). Thus, fuel injected by the starting asynchronous injection is sucked into the combustion chamber during the intake stroke made by the first rotation of the crankshaft and makes an initial explosion by ignition at the next compression top dead center, whereby the engine starts to rotate. Thereby, the engine rotational speed becomes equal to or higher than a prescribed rotational speed for permitting stroke detection, and stroke detection is permitted. However, the rotation of the engine is still unstable and the engine has not gone into a stable idling state.

After the operation mode has been set to "3", stroke detection based on an engine rotational speed difference ΔN and stroke detection based on an intake air pressure difference ΔP are performed at each bottom dead center. However, a stroke cannot be easily detected since the engine rotational speed and the intake air pressure are still unstable. When the engine rotational speed difference ΔN becomes the threshold value $\Delta N_{IN}$ of the engine rotational speed difference after an intake stroke or smaller at the third bottom dead center, the flag $F_N$ for the stroke detection based on the engine rotational speed difference is set to "2" and the counter $CNT_N$ for the stroke detection based on the engine rotational speed difference is incremented to "1" since the temporary stroke differs from the detected stroke. Then, since the engine rotational speed difference ΔN is the threshold value $\Delta N_{IN}$ of the engine rotational speed difference before the exhaust stroke or smaller again at the fourth bottom dead center, which means the temporary stroke differs from the detected stroke, the flag $F_N$ for stroke detection based on the engine rotational speed difference is kept at "2", and the counter $CNT_N$ for stroke detection based on the engine rotational speed difference is incremented and counted up to "2". At the same time, the intake air pressure difference ΔP becomes the threshold value $\Delta P_{EX}$ of the intake air pressure difference before the exhaust stroke or greater, which means the temporary stroke differs from the detected stroke, the flag $F_P$ for the stroke detection based on the intake air pressure difference is set to "2" and the counter $CNT_P$ for the stroke detection based on the intake air pressure difference is incremented to "1". As a result, the operation mode is set to "4" and the numbers of the crank pulses are shifted by a phase of 360°. Thereby, the true stroke is detected and the stroke detection is completed.

Figure 14:
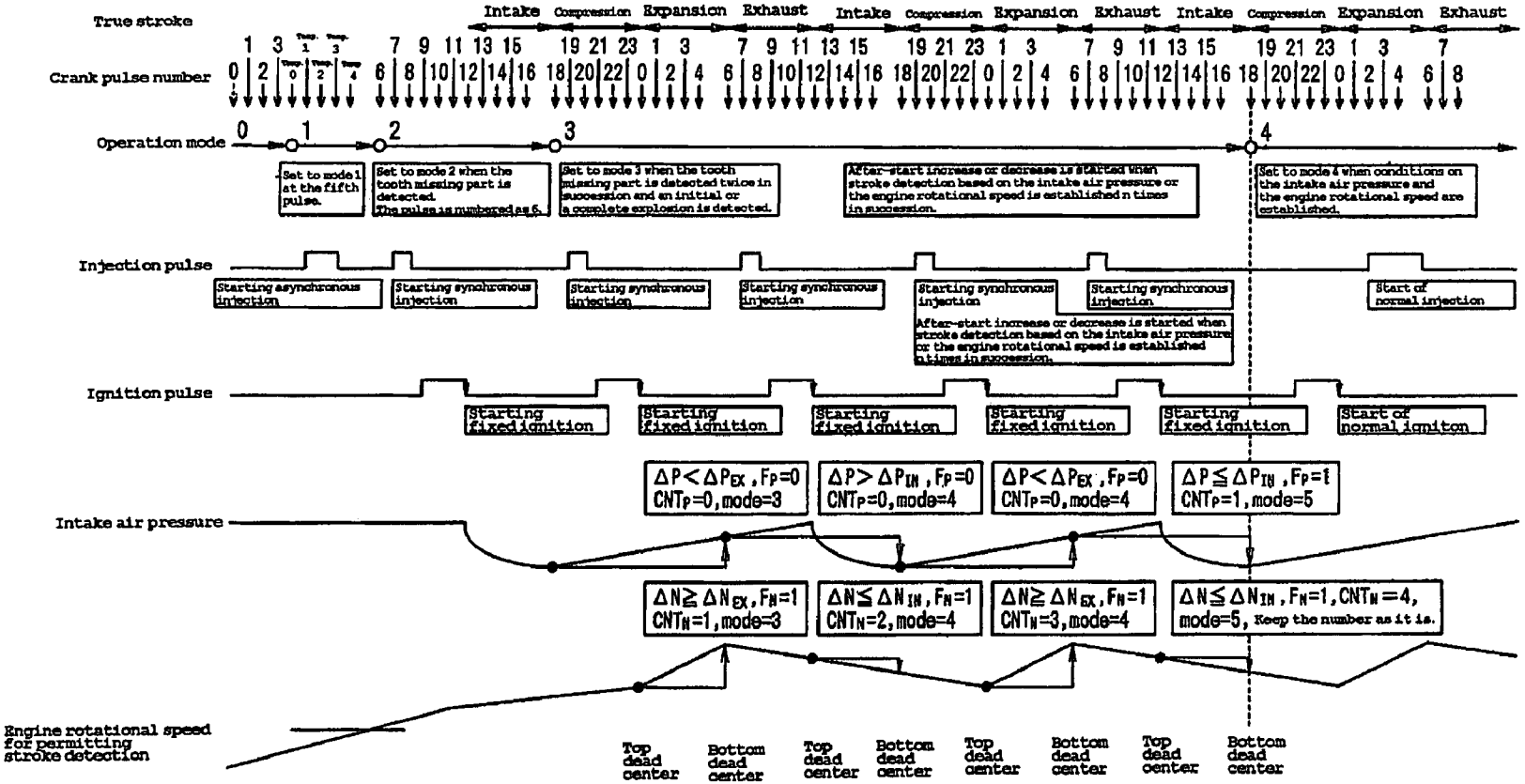
FIG. 14 is an explanatory view illustrating an operation at a start of the engine by the operation shown in FIG. 3.

FIG. 14 shows the variation in crank pulses (the numbers thereof), the operation mode, the injection pulses, the ignition pulses, intake air pressure and the engine rotational speed with the time at the time when the engine starts to rotate from compression top dead center. Numbering, setting of the operation mode, setting of the fuel injection amount and the fuel injection timing, and setting of the ignition timing immediately after the start of the rotation are performed in the same manner as shown in FIG. 12. The crank pulse "6" after the tooth missing part after the operation mode has been set to "2" indicates bottom dead center after explosion, so that the temporary stroke coincides with the true stroke. In this simulation, the engine starts to rotate from compression top dead center, so that fuel injected by the starting asynchronous injection and fuel injected by the starting synchronous injection performed during the second rotation of the crankshaft are sucked into the combustion chamber by the intake stroke during the second rotation of the crankshaft and make an initial explosion by ignition at compression top dead center during the third rotation of the crankshaft, whereby the engine starts to rotate. Prior to this, since the engine rotational speed generated by the starter motor becomes the prescribed rotational speed for permitting stroke detection or higher, stroke detection is permitted. However, the rotation of the engine is still unstable and the engine has not gone into a stable idling state.

Also in this simulation, after the operation mode has been set to "3", stroke detection based on an engine rotational speed difference ΔN and stroke detection based on an intake air pressure difference ΔP are performed at each bottom dead center. In this simulation, the engine rotational speed difference ΔN becomes the threshold value $\Delta N_{EX}$ of the engine rotational speed difference before the exhaust stroke or greater at the first bottom dead center after the operation mode has been set to "3", which means the temporary stroke coincides with the detected stroke. Thus, the flag $F_N$ for stroke detection based on the engine rotational speed difference is set to "1" and the counter $CNT_N$ for stroke detection based on the engine rotational speed difference is incremented to "1". Then, at the second bottom dead center, the engine rotational speed difference ΔN is the threshold value $\Delta N_{IN}$ of the engine rotational speed difference after the intake stroke or smaller, which means that the temporary stroke coincides with the detected stroke. Thus, the flag $F_N$ for stroke detection based on the engine rotational speed difference is kept at "1" and the counter $CNT_N$ for stroke detection based on the engine rotational speed difference is incremented and counted up to "2". Then, since the counter $CNT_N$ for stroke detection based on the engine rotational speed difference counts up with the flag $F_N$ for stroke detection based on engine rotational speed difference at "1", the temporary stroke detection is completed.

Thereafter, since the engine rotational speed difference ΔN is the threshold value $\Delta_{EX}$ of the engine rotational speed difference before the exhaust stroke or greater at the next bottom dead center, which means the temporary stroke coincides with the detected stroke, the flag $F_N$ for stroke detection based on the engine rotational speed difference is kept at "1" and the counter $CNT_N$ for stroke detection based on engine rotational speed difference is incremented to "3". At the next bottom dead center, the engine rotational speed difference ΔN is the threshold value $\Delta N_{IN}$ of the engine rotational speed difference after the intake stroke or smaller, which means that the temporary stroke coincides with the detected stroke, so that the flag $F_N$ for stroke detection based on the engine rotational speed difference is kept at "1" and the counter $CNT_N$ for stroke detection based on the engine rotational speed difference is incremented to "4". At the same time, the intake air pressure difference ΔP is the threshold value $\Delta P_{IN}$ of the intake air pressure difference after the intake stroke or smaller at the bottom dead center, which means that the temporary stroke coincides with the detected stroke, the flag $F_P$ for the stroke detection based on the intake air pressure difference is set to "1", and the counter $CNT_P$ for the stroke detection based on the intake air pressure difference is incremented to "1". As a result of this, the operation mode is set to "4" and the numbers attached to the crank pulses are left unchanged as the true strokes, and the stroke detection is completed.

In the above embodiment, description has been made of an engine of the type in which fuel is injected into an intake pipe but the engine control device of the present invention is applicable to a direct injection engine.

Also in the above embodiment, description has been made of a single-cylinder engine but the engine control device of the present invention is applicable to a multi-cylinder engine having two or more cylinders.

The engine control unit may be an operation circuit instead of the microcomputer.

As has been described above, according to the engine control device of the present invention, a stroke is detected based on variation in intake air pressure and a stroke is detected based on variation in engine rotational speed, and the stroke detection is completed when the detected strokes coincide with each other. Thus, there is no need to select a stroke detection method according to the engine operating condition. Also, since the low reliability of each detection method can be compensated, the reliability of the detected stroke is high.

What is claimed is:

1. An engine control device, comprising:

crankshaft phase detecting means for detecting a phase of a crankshafts;

intake air pressure detecting means for detecting an intake air pressure in an intake pipe of an engine;

stroke detecting means for detecting a stroke of the engine based on at least the phase of the crankshaft detected by the crankshaft phase detecting means;

engine control means for controlling an operating condition of the engine based on the stroke of the engine detected by the stroke detecting means and the intake air pressure detected by said intake air pressure detecting means; and engine rotational speed detecting means for detecting an engine rotational speed, wherein the stroke detecting means detects a stroke based on a variation in intake air pressure detected by the intake air pressure detecting means and detects a stroke based on a variation in the engine rotational speed detected by the engine rotational speed detecting means, and completes stroke detection when the detected strokes coincide with each other.

2. An engine control device, comprising:

a crank angle sensor that detects a phase of a crankshaft;

an intake air pressure sensor that detects an intake air pressure in an intake pipe of an engine;

a stroke detection permitting part that detects a stroke of the engine based on at least the phase of the crankshaft detected by the crank angle sensor;

an engine control unit that controls an operating condition of the engine based on the stroke of the engine detected by the stroke detection permitting part and the intake air pressure detected by the intake air pressure sensor; and an engine rotational speed calculating part that detects an engine rotational speed, wherein the stroke detection permitting part detects a stroke based on a variation in intake air pressure detected by the intake air pressure sensor and detects a stroke based on a variation in the engine rotational speed detected by the engine rotational speed calculating part, and completes stroke detection when the detected strokes coincide with each other.

3. The engine control device according to claim 2, wherein the crankshaft includes a plurality of teeth.

4. The engine control device according to claim 2, wherein the crank angle sensor is a magnetic sensor.

5. The engine control device according to claim 3, wherein the plurality of teeth are formed on an outer periphery of the crankshaft at equal intervals.

6. The engine control device according to claim 2, wherein the engine control unit is a microcomputer.

7. The engine control device according to claim 2, wherein the engine rotational speed calculating part calculates the rotational speed of the crankshaft as an output shaft of the engine.

8. The engine control device according to claim 2, wherein the stroke detection permitting part outputs stroke detection permitting information.

9. The engine control device according to claim 2, wherein the engine rotational speed calculating part calculates instantaneous engine speeds at top and bottom dead centers.

10. The engine control device according to claim 2, further comprising a cooling water temperature sensor that detects a temperature of the engine.

11. The engine control device according to claim 2, further comprising an exhaust air-fuel ratio sensor that detects an air-fuel ratio of an exhaust pipe.

12. The engine control device according to claim 2, further comprising an intake temperature sensor that defects a temperature of the intake pipe.

13. A method for manufacturing an engine control device, comprising:

detecting a phase of a crankshaft;

detecting an intake air pressure in an intake pipe of an engine;

detecting a stroke of the engine based on at least the phase of the crankshaft;

controlling an operating condition of the engine based on the stroke of the engine and the intake air pressure;

detecting an engine rotational speed;

detecting a stroke based on a variation in intake air pressure;

detecting a stroke based on a variation in the engine rotational speed; and completing stroke detection when the detected strokes coincide with each other.

14. The method for manufacturing an engine control device according to claim 13, further comprising providing the crankshaft with a plurality of teeth.

15. The method for manufacturing an engine control device according to claim 14, further comprising forming the plurality of teeth on an outer periphery of the crankshaft at equal intervals.

16. The method for manufacturing an engine control device according to claim 13, further comprising calculating the rotational speed of the crankshaft as an output shaft of the engine.

17. The method for manufacturing an engine control device according to claim 13, further comprising outputting stroke detection permitting information.

18. The method for manufacturing an engine control device according to claim 13, further comprising calculating instantaneous engine speeds at top and bottom dead centers.

19. The method for manufacturing an engine control device according to claim 13, further comprising detecting a temperature of the engine.

20. The method for manufacturing an engine control device according to claim 13, further comprising detecting an air-fuel ratio of an exhaust pipe.

* * * * *